US005580128A

United States Patent [19]

Johnson et al.

[11] Patent Number: 5,580,128

[45] Date of Patent: Dec. 3, 1996

[54] THERAPEUTIC SEAT

[76] Inventors: Robert E. Johnson, 35 Elmcrest Ave., Providence, R.I. 02908; David H. Johnson, 175 Bartlet Ave., Providence, R.I. 02905

[21] Appl. No.: 288,018

[22] Filed: Aug. 10, 1994

[51] Int. Cl.[6] ..... A47C 7/02

[52] U.S. Cl. ..... 297/314; 297/312; 297/338; 297/452.25; 297/452.4

[58] Field of Search ..... 297/312, 314, 297/201, 202, 338, 452.4, 284.3, 452.23, 452.24, 452.25

[56] References Cited

U.S. PATENT DOCUMENTS

| | | | |
|---|---|---|---|
| 432,125 | 7/1890 | Duryea | 297/312 |
| 749,865 | 1/1904 | Jarvis | 297/312 |
| 4,541,668 | 9/1985 | Rouw | 297/201 |
| 4,877,286 | 10/1989 | Hobson et al. | 297/201 |
| 4,921,303 | 5/1990 | White | 297/338 |

*Primary Examiner*—Peter M. Cuomo
*Assistant Examiner*—Anthony D. Barfield
*Attorney, Agent, or Firm*—Robert J. Doherty

[57] ABSTRACT

The invention is an improved seat device to be used by those who have pain or discomfort sitting on a regular seat. The seat device can be attached to a chair frame or be used as a portable unit in the home or while traveling.

14 Claims, 7 Drawing Sheets

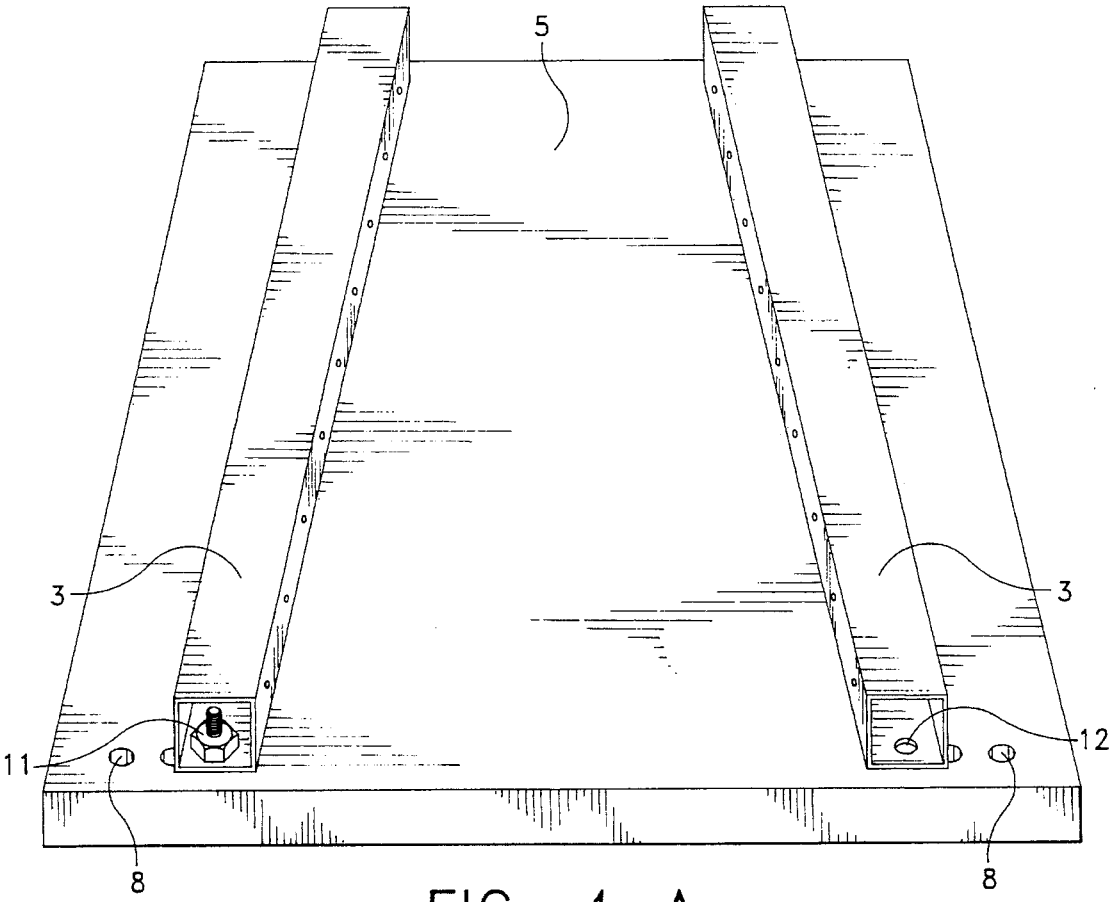
FIG. 4-A
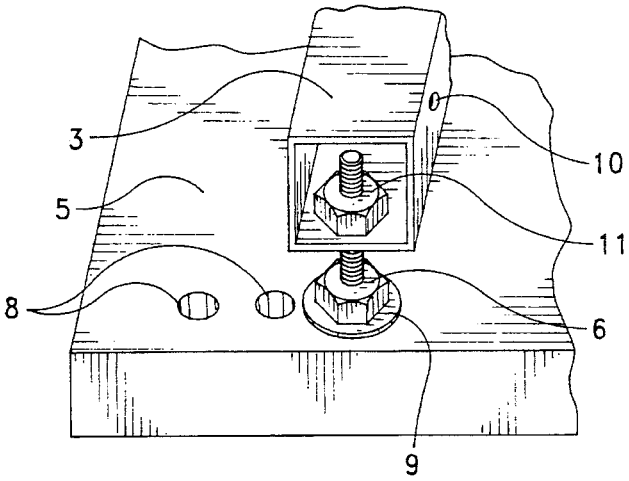
FIG. 4-B
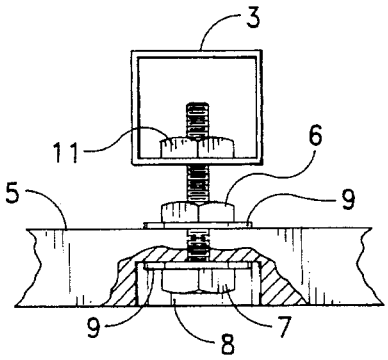
FIG. 4-C

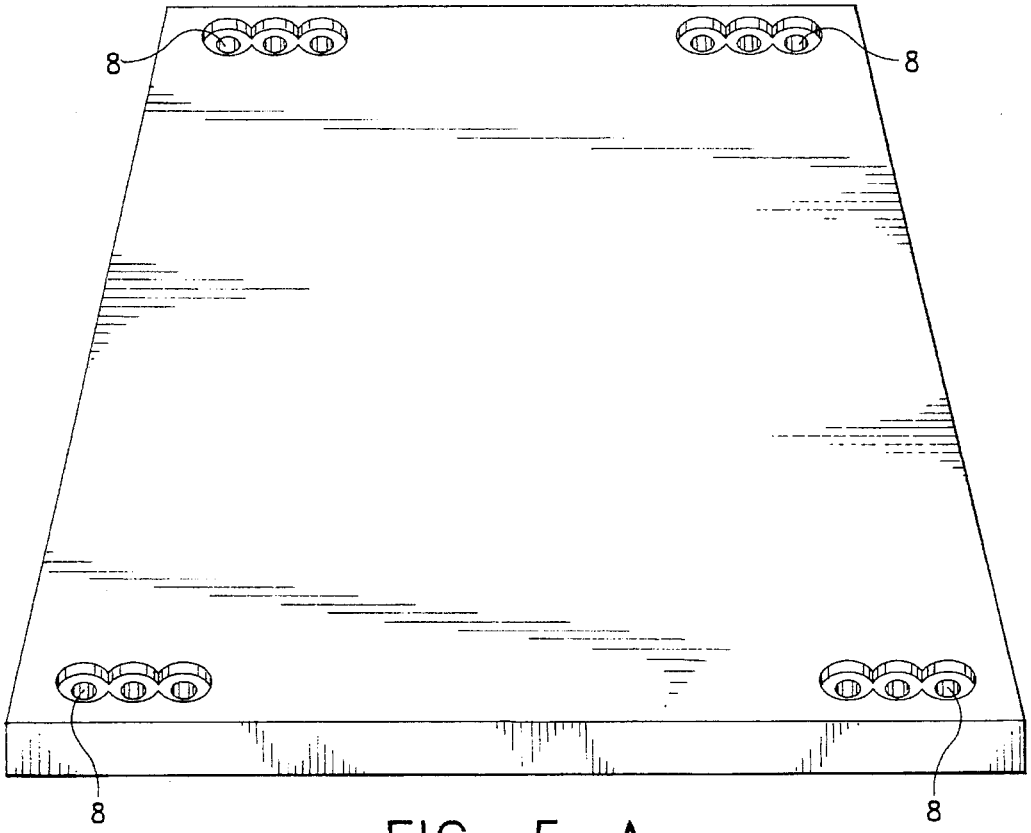
FIG. 5-A
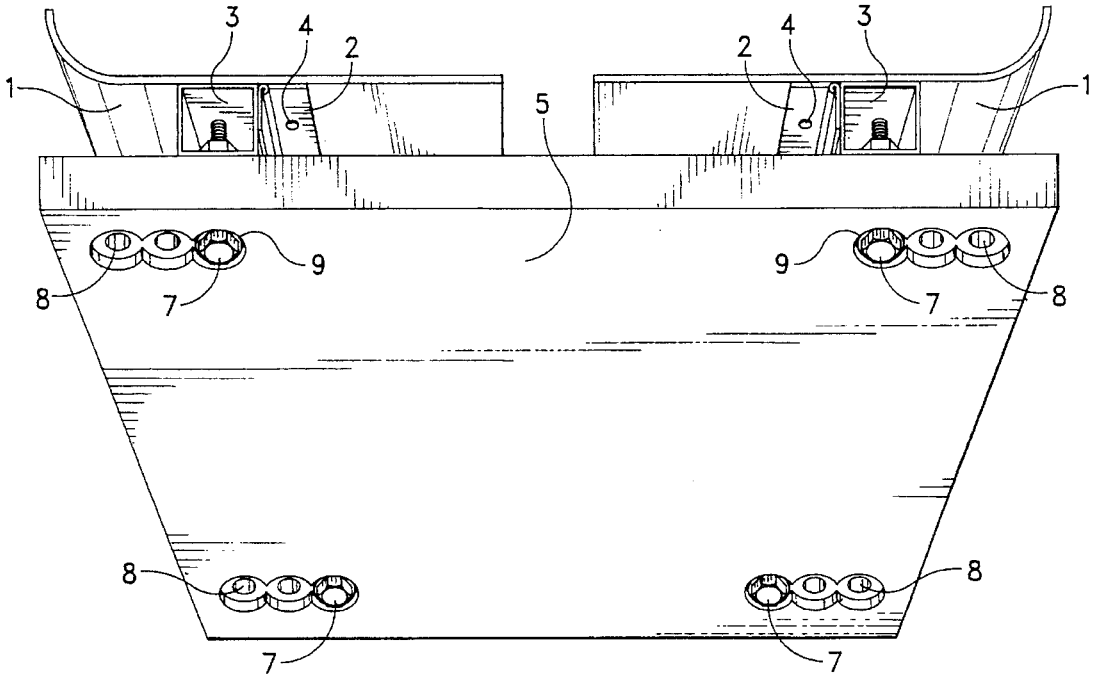
FIG. 5-B

THERAPEUTIC SEAT

DESCRIPTION

This device is a seat the consists of two divided panels molded to curve up on the outer edge. The two sections are attached along the length of each to a support channel by a piano hinge. The support channel is secured to the base by means of adjustable bolts placed through multiple openings allowing the seat panels to be moved about on the base both to widen the seat area and also to raise the panels to achieve a greater degree of angle thereby gaining a larger opening under the bottom of the person thus adding to the degree of comfort obtainable.

The sections of the seat can be covered with a foam or other cushion materiel and both sections covered with a form fitting, removable seat cover with a center panel designed to expand and contract with the movement of the panels. For sanitary reasons the seat cover should be washable or disposable.

Each seat panel has at its' center point, along the upper ridge, an outward molded section to be used as a support for the hand. In sitting, the person places the heal of the hand and thumb on each support and having the body weight on the hands then lowers the body into the seat by relaxing the downward pressure on the hands. To aid in lifting the body out of the seat you grasp the support section and press down releasing the side pressure on the thighs and at the same time raising the center of the seat panels as the body is lifted off the seat.

Each seat panel also may be notched at both ends of the inner facing edge of said panels, when being used with a centrally opened base embodiment, so as to allow the said inner edge of the seat panel to drop into the opening of the frame, thereby increasing the degree of tilt adjustment available.

BACKGROUND

The background of this device comes from a personal experience of pain following several operations for Prostate Cancer. Following an operation of that type it is very uncomfortable to sit for any length of time. Lying down brings relief, but also invites complications of circulation and respiration. The current selection of donut cushions give little support or relief of discomfort.

To better understand the feeling of the discomfort, imagine sitting on a golf ball. That is the result of both the operation and the insertion of a catheter following such procedures. The bulb that holds the catheter in place is representative of a small ball.

What was needed was a device that could give solid support while seated without the pressure of the body weight over that very sensitive area.

The solution is a combination of opening the area under the discomfort zone, while at the same time, transferring the support from the bottom to the outer portion of the hips and thighs. The combination is achieved with the Therapeutic Seat.

The therapeutic seat is a device consisting of two separate panels molded to the shape of the lower body and thighs. Each panel is attached to a support channel by riveting one face of a piano hinge to the panel and the other face to a support channel allowing the panel to tilt down towards the center along the length of the panel, the support channel is attached to a base by a nut and bolt combination to allow for various adjustments. The action of sitting into the seat causes the panels to tilt down, opening the area under the persons bottom while at the same time transferring the support pressure from the bottom to the sides. The greater the angle of tilt results in a proportionate degree of additional distribution of pressure from the bottom to the sides. This combination of the three divided weight points also keeps the pelvis centered on the spinal column.

The bolts that attach the seat panels to the base are also used to make a wide variety of adjustments to accommodate various sizes and shapes.

The hand holds built into the top edge of the seat panels allow for a more gentle sitting and rising up from the seat by giving the user a firm control of this action.

Foam padding plus a washable cover with an expandable center panel would add to the ascetics and comfort of the seat device.

The types of patents searched:

Chair U.S. Pat. No. 427,201 with sub class 195.1 and 297 also design patents Design U.S. Pat. Nos. D 06,334, D 339 003, D 332 897 and D342 388

BRIEF DESCRIPTION OF DRAWINGS

FIG. 4-A Shows the support channels as they would be connected to a base.

FIG. 4-B Shows an enlarged portion of the channel and the base bolt.

FIG. 4-C Shows and end view in cut-a-way to show all the connecting pieces used in making adjustments.

FIG. 5 A Shows the underside of the base with four openings used in making adjustments.

FIG. 5B Shows the underside of the base and the panels, hinges and channels as they would be connected to the base.

DETAILED DESCRIPTION OF DRAWINGS

Figure 1:
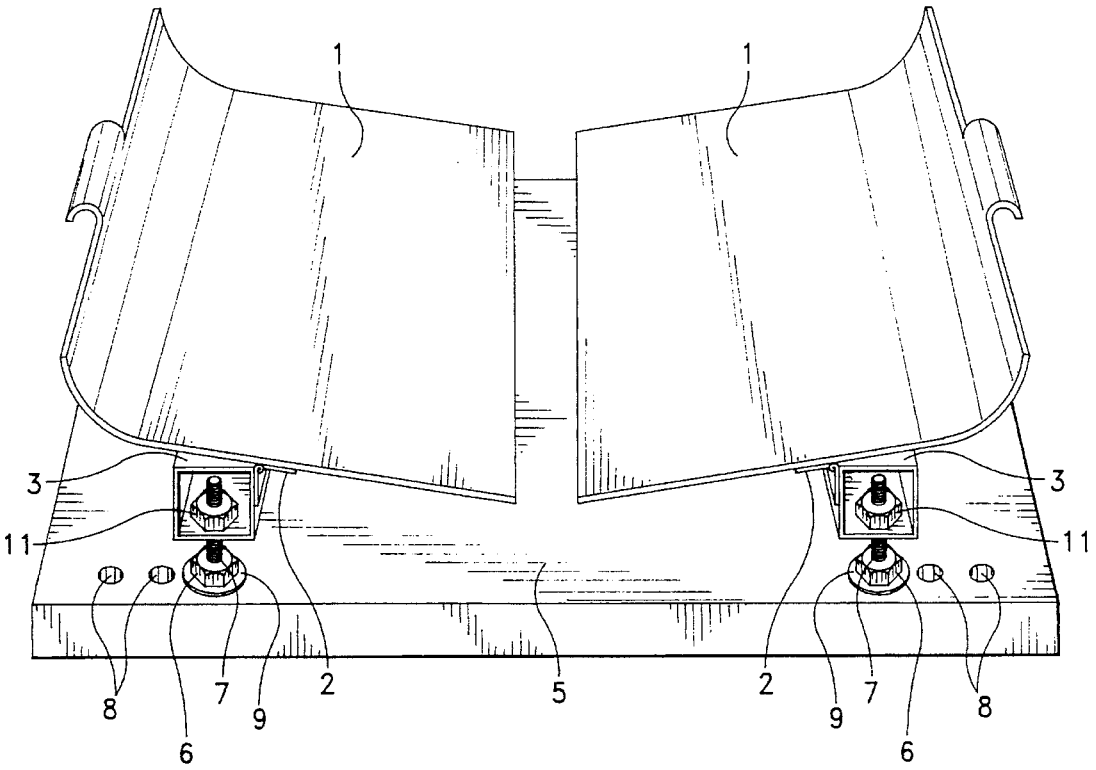
FIG. 1 Shows the seat and all its assembled parts as it would be used as a portable unit.

FIG. 1 Shows as it would be used as a portable unit. The seat panel #1 is molded to the shape of the lower body. It has an extended outer curved hand hold to comfortably facilitate the lowering of the body into the seat and upon rising from it. The seat panel can be notched at both ends of the inner facing edge, so as to allow said inner edge of the seat panel to drop below the top edge of the frame, thereby increasing the degree of tilt adjustment available. A piano hinge #2 is riveted to the bottom of the seat panel #1 and also to a channel support #3 which has a nut #11 welded to the inside base of the channel to accept and support the adjustment bolt #7. The base #5 has four openings #8, two for each panel #1 with three separate adjustment positions to receive bolt #7 and washer #9. The bolt stem passes the opening #8 from the bottom of the base and through a second washer #9. A lock nut #6 is loosely threaded through the nut #11 which is welded to the channel seat support #3. When the desired adjustment of the channel #3 is reached the lock nut #6 is then tightened on bolt #7. Each of the four adjustment positions #8 can be used to raise or lower the seat panel #1 or bring it closer together or further apart. It can also be adjusted to bring the seat panels #1 closer together at one end while spreading them wider at the other end to accommodate various shaped bottoms with the greatest degree of comfort.

Figure 2:
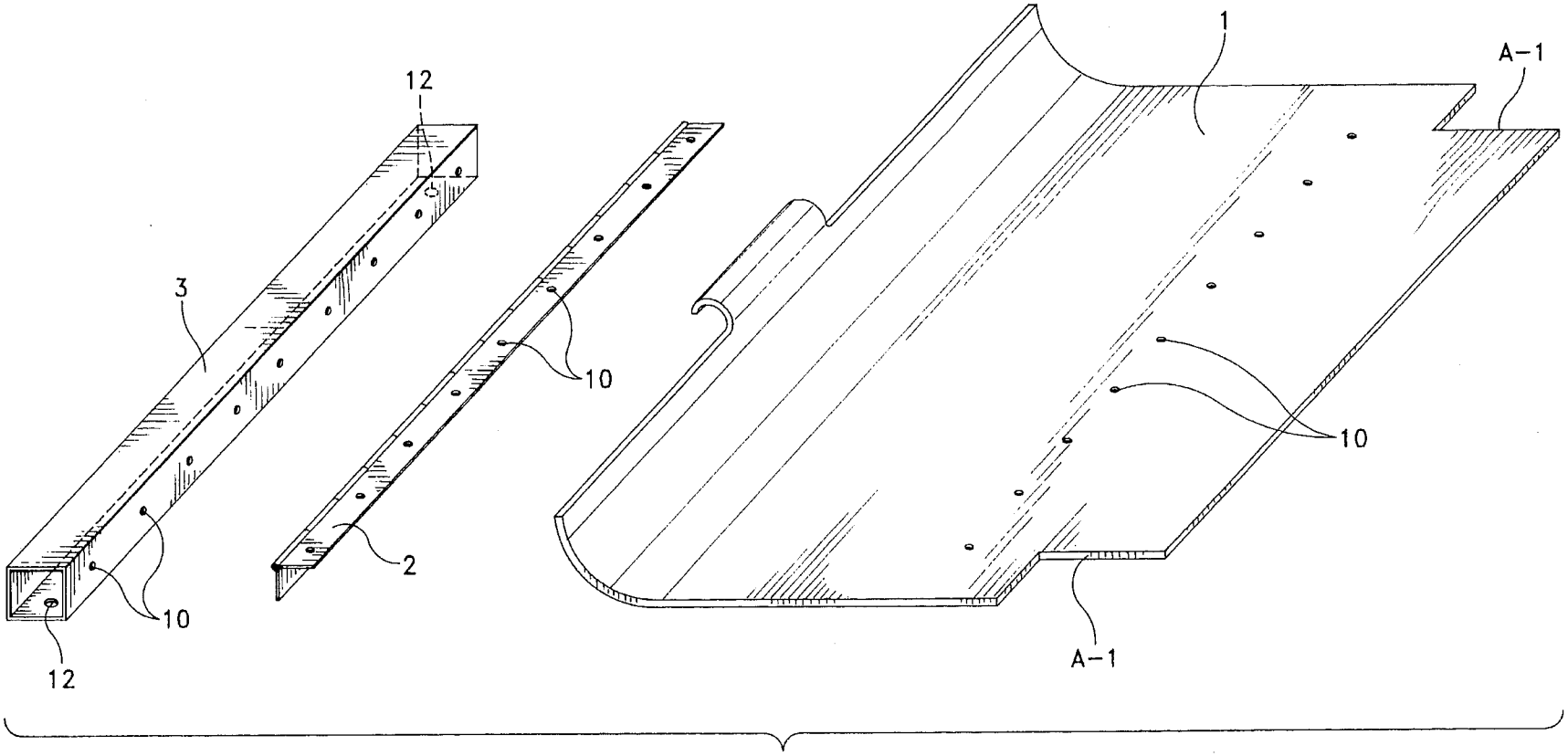
FIG. 2 Shows an exploded view of the left panel, the hole positions where it would be attached to a piano hinge and then to a support channel.
Figure 3:
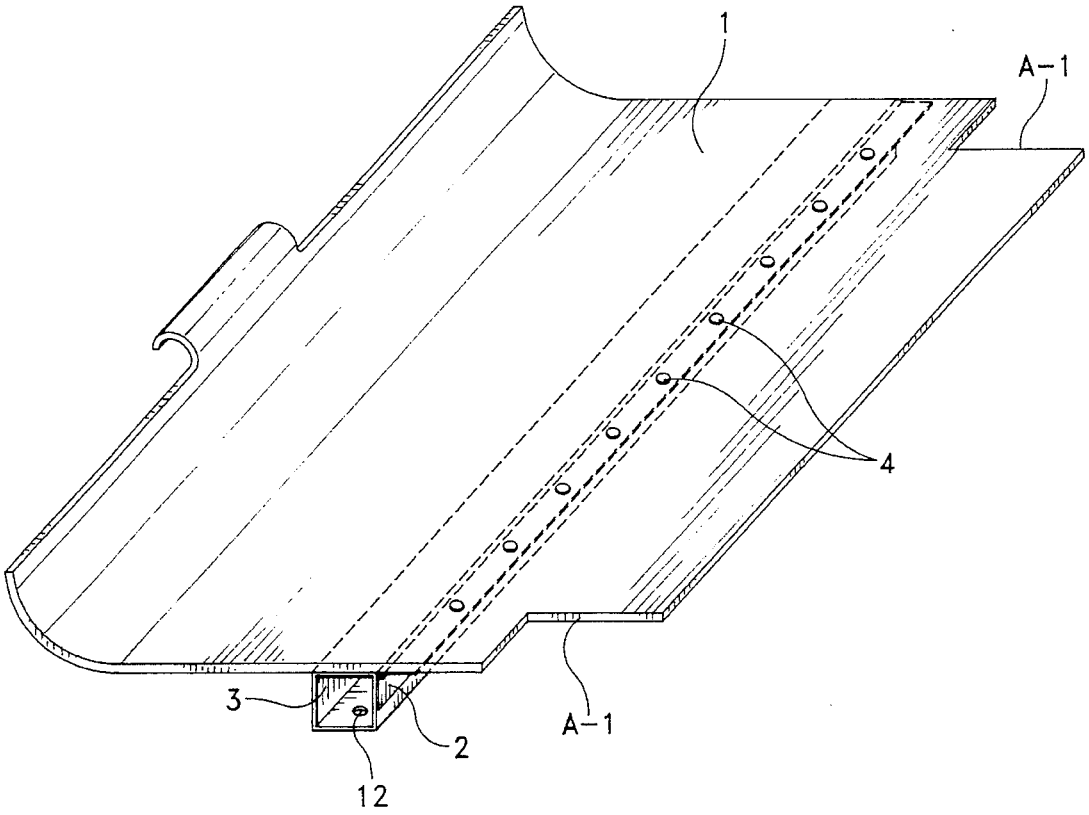
FIG. 3 Shows all the parts in FIG. 2 connected.
Figure 7:
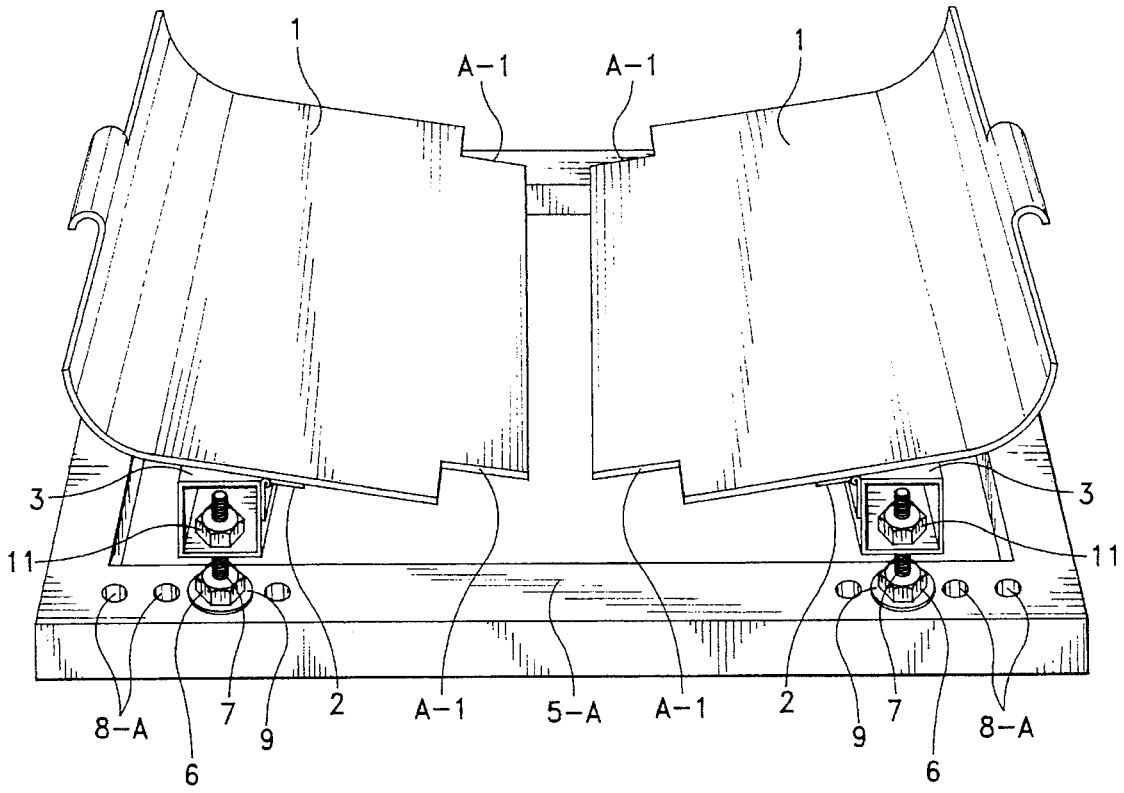
FIG. 7 is a top view with a channel style frame base.

FIG. 2 Shows an expanded view of one panel unit. It shows a metal channel #3 with nine side holes #10 to accommodate the rivets to hold one side of the piano hinge #2 in place. The seat panel #1 is shown with nine corresponding holes #10 that would accommodate the rivets attaching the seat panel to the other section of the piano hinge #2. The three elements would be attached so to allow the inner portion of the seat panel to tilt down raising the outer portion of the panel. Notched sections A-1 allow for even greater tilt angle when used with an open frame #5 as shown in FIG. 7.

FIG. 5 Shows the seat panel #1 attached to the channel #3 by means of a piano hinge #2 and rivets #4. The hole #12 in the bottom of the channel is to accommodate the adjustment bolt #7.

FIG. 4-A Shows the seat support channel #3 in position over the base #5 with the hole #12 in the channel #3 aligned over the hole #8 in the base #5.

FIG. 4-B Shows the channel #3 as it might be attached to the base #5 with the adjustment bolt #7 passing through a washer #9 and thence through one of the three or more holes #8 in the base #5, thence through another washer #9 and loosely threaded through a lock nut #6. The bolt #7 is then attached to the channel #3 through a nut #11 that is securely welded to the inner base of the channel #3.

FIG. 4-C An end view, shows how the height of the channel is adjusted by turning the bolt thread through the nut #11. Once the desired adjustment is achieved then the lock nut #6 is tightened over the washer #9 on bolt #7 to secure the channel #3 to the base #5.

FIG. 5-A Shows a bottom view of the base #5 with adjustment holes #8. The adjustment holes are drilled out through the bottom of base #5 deep enough to accommodate a washer #9 and the head of bolt #7 so as to be flush with the bottom of the base #5.

FIG. 5-B Shows an underside view of the seat panel #1 as it is attached to the channel #3 with the piano hinge #2 thence bolted to the base #5 with bolt #7 through washer #9 passing through one of the several openings of hole #8.

Figure 6:
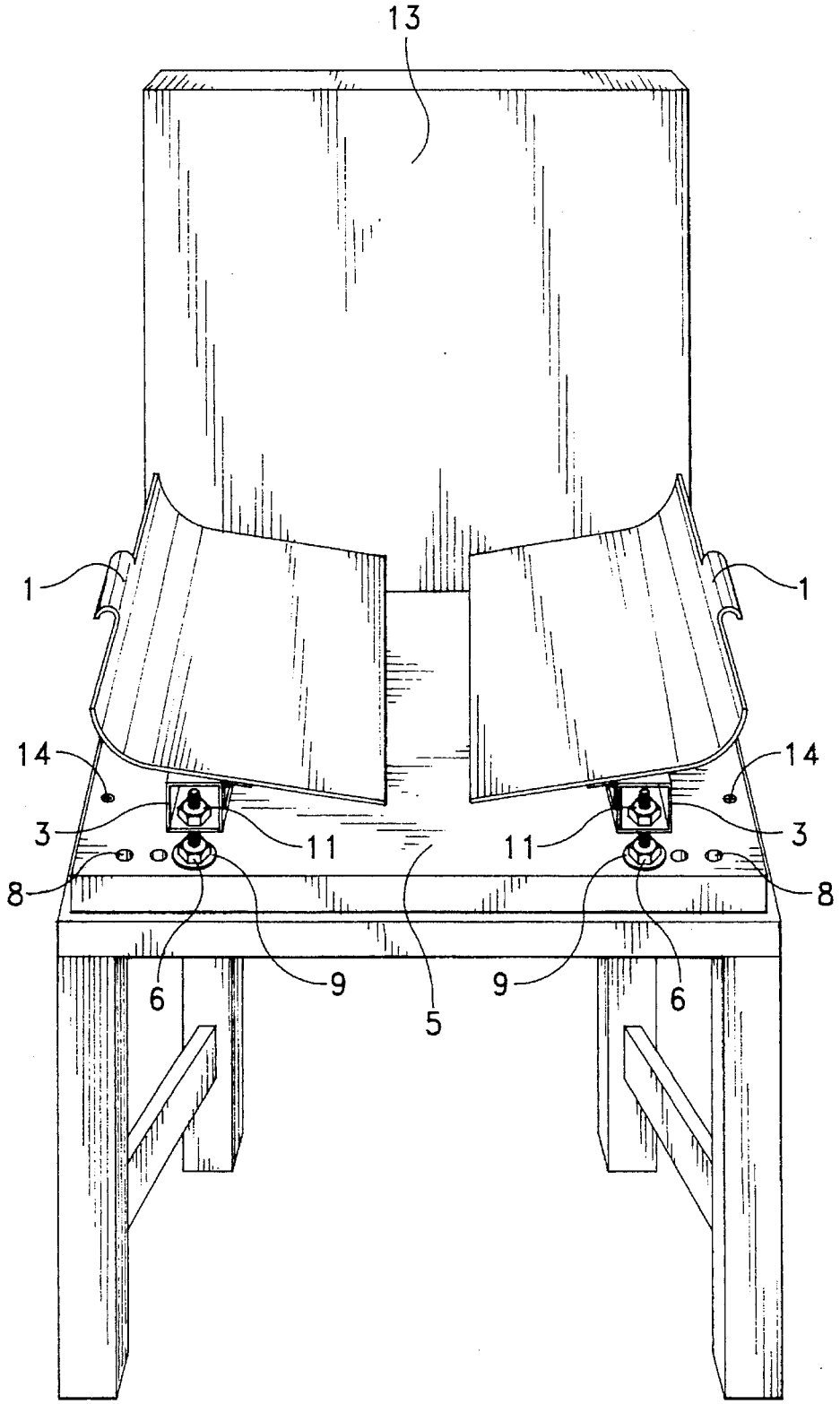
FIG. 6 shows the seat attached to a chair frame.

FIG. 6 Shows how the seat would be used on a chair frame #13 attached securely to the frame by screws #14.

FIG. 7 Shows a modified form of a seat as it could be used as a portable unit. The seat panel #1 is molded to the shape of the lower body. It has an extended outer curved hand hold to comfortably facilitate the lowering of the body into the seat and upon rising from it. The seat panel can be notched at both ends of the inner facing edge A-1, so as to allow said inner edge of the seat panel to drop below the top edge of the frame or base #5-A, thereby increasing the degree of tilt adjustment available. A piano hinge #2 is riveted to the bottom of the seat panel #1 and also to a channel support #3 which has a nut #11 welded to the inside of the base of the channel to accept and support the adjustment bolt #7. The base #5-A has sixteen openings #8-A, eight for each panel #1 to receive bolt #7 and washer #9. The bolt stem passes the opening #8-A from the bottom of the base and through a second washer #9. A lock nut #6 is loosely threaded through the nut #11 which is welded to the channel seat support #3. When the desired adjustment of the channel #3 is reached the lock nut #6 is tightened on bolt #7. Each of the four adjustment positions #8-A can be used to raise or lower the seat panel #1 or bring it closer together or move it further apart.

SUMMARY OF THE INVENTION

In summary, this adjustable seat device with separate hinged support panels will ease the distress of sitting for persons who suffer the after effects of an operation, giving birth, lower back problems, hemorrhoids and other conditions such as having a catheter inserted and for those who require the use of heavy pads for incontinence. The tilting action of the device opens an area directly under the center of the bottom while at the same time transfers the weight of the body support from the bottom to the sides.

The advantage of the device over the present donut type objects now available is it's ability to deliver relief while maintaining the body in a firm but comfortable position and it's adaptability to different body sizes and shapes.

The therapeutic value of this seat invention is to allow a person to sit in an upright position, more comfortably and for a longer period of time than present devices allow thereby encouraging quicker healing and the avoidance of problems that follow an operation when a person cannot be supported in this more desirable position.

The unit can be attached to a chair frame or be used as a portable seat when traveling.

This invention may be embodied in several forms without departing from the spirit or essential characteristics thereof and the present embodiment is therefore illustrative and not restrictive.

1. The split panel seat allows for an opening under the center part of the bottom eliminating pressure to a sensitive area.
2. The outer part of the seat panel is molded to the round shape of a thigh and the tilt action of the panel allows the weight of a person sitting into the seat to be partially transferred from the center to the outer molded edges causing the outer thighs to rotate inwardly as the curved side pressure is applied. This action causes the persons bottom to be opened slightly adding to the comfort of sitting. The design is such that the curved portion of the seat and the inward tilting action allows the thighs to accept a greater role of supporting the body while seated.
3. The upper outwardly curved edge of the seat panel can be grasped by the heal of the hand and the thumb to support the person when sitting into the seat and in rising from it by pressing down thereby opening the outer edges and gently raising the center portion of the seat panels.
4. The therapeutic seat, as described in FIG. 1 and FIG. 7, can be used as a portable seat for use in the home or while traveling or be attached to a chair frame.
5. To increase comfort the device has four adjustment bolts capable of holding the seat panels in any of six positions. Attached to the bolts are lock nuts enabling additional adjustments to be made altering the configuration of the seat panels to obtain the greatest degree of comfort for the user. This is achieved by raising the panels and the support channels thereby increasing the angle of the seat panel when sitting which increases the amount of support pressure transferred to the thighs. Additional adjustments are achieved by raising or lowering just the front or rear portion of the panels.
6. The inner facing edge of the seat panels may be notched as shown in FIG. 7 thus allowing said edge to be lowered beneath the top most part of the frame for an additional degree of tilt adjustment. Each seat panel is notched at both ends of the inner facing edge of said panels, so as to allow the said inner edge of the seat panel to drop into the opening of the frame, thereby increasing the degree of tilt adjustment available.

We claim:

1. A seating device for the therapeutic support of the bottom area of a human comprising a pair of separate generally longitudinally oriented panels said panels compositively defining a pair of inner edge walls and a pair of outer edge walls so that said panels form a generally planar upper surface for the respective supporting contact with the respective buttock and upper rear thigh portions of said human, a base and means for connecting said panels to said base at a position wherein said panel upper surfaces are vertically spaced from said base, said inner edge walls disposed in laterally spaced opposition to each other so as to form a longitudinally directed central relief opening between said panels such that the centrally disposed genital areas of said human user do not contact said panels or said base when said device is used to support said human, and each of said panels including means for at least partially restraining outward lateral movement of the upper leg portions of the human user, said outer edge walls terminating in an upward outward flare so as to form a panel side restraint portion whereby outer side thigh portions of a human user may contact said side restraint panel portion to prevent lateral outward movement of the user's legs.

2. The device of claim 1, including means for vertically adjusting said panels in relationship to said base.

3. The device of claim 2, including means for laterally adjusting said panels with respect to each other so as to increase or reduce the width of said central relief opening.

4. The device of claim 1, including means for laterally adjusting said panels with respect to each other so as to increase or reduce the width of said central relief opening.

5. The device of claim 4, said means for laterally adjusting said panels including separate means at opposed longitudinally separated positions on said base such that both the width and shape of said central relief opening can be varied.

6. The device of claim 1, said panels connected to said base so as to permit the inner edge walls of said panels to simultaneously tilt downwardly apart from each other when normally supporting the weight of a human seated thereon to an alternate position where said inner edge walls simultaneously tilt upwardly towards each other as when force is downwardly exerted upon said outer edge walls as when a human contacts such outer edge walls as in a lifting off motion with his or her arms.

7. The device of claim 6, said panels including a hand rest portion for the hands of the human user.

8. The device of claim 1, said panel side restraint portions including a hand rest portion for contact by the hands of the human user.

9. A seating device for the therapeutic support of the bottom area of a human comprising a pair of separate generally longitudinally oriented panels, each having a generally planar upper surface for the respective supporting contact with the respective buttock and upper rear thigh portions of said human, a base in turn having an upper surface and means for connecting said panels to said base at a position wherein said panel upper surfaces are vertically spaced from said base upper surface, said panels compositively defining a pair of inner edge walls disposed in laterally spaced opposition to each other so as to form a longitudinally directed central relief opening between said panels such that the centrally disposed genital areas of said human user do not contact said panels or said base upper surface when said device is used to support said human, said means for connecting said panels to said base comprising a pair of longitudinally oriented channel members having vertically opposed upper and lower walls and at least one connecting side wall, said panels being in turn respectively connected to said channel members including means for vertically adjusting the spacing between said panels and said base, said vertical adjusting means including a pair of rotatable threaded bolts longitudinally spaced from each other and positioned to support said channel from said base for each respective panel, said bolts threadably connected at their upper ends with said channel such that rotation of said bolts serves to raise and lower said channel and accordingly its respective panel vis-a-vis said base.

10. The device of claim 9, including nut means secured to said channel lower wall for threadable contact with said bolts.

11. A seating device for the therapeutic support of the bottom area of a human comprising a pair of separate generally longitudinally oriented panels, each having a generally planar upper surface for the respective supporting contact with the respective buttock and upper rear thigh portions of said human, a base in turn having an upper surface and means for connecting said panels to said base at a position wherein said panel upper surfaces are vertically spaced from said base upper surface, said panels further compositively defining a pair of inner edge walls disposed in laterally spaced opposition to each other so as to form a longitudinally directed central relief opening between said panels such that the centrally disposed genital areas of said human user do not contact said panels or said base upper surface when said device is used to support said human, said panels laterally adjustable with respect to each other so as to increase or reduce the width of said central relief opening, said panel lateral adjustment means including separate means at opposed longitudinally separated positions on said base such that both the width and shape of said central relief opening can be varied, said means for connecting said panels to said base comprising a pair of longitudinally oriented channel members having vertically opposed upper and lower walls and at least one connecting side wall, said panels being in turn respectively connected to said channel members, including means for vertically adjusting the spacing between said panels and said base, said vertical adjusting means including a pair of rotatable threaded bolts longitudinally spaced from each other and positioned to support said channel from said base for each respective panel, said bolts threadably connected at their upper ends with said channel such that rotation of said bolts serves to raise and lower said channel and accordingly its respective panel vis-a-vis said base.

12. The device of claim 11, each said bolt having a head positionable in a series of laterally adjacent pockets opening upwardly from the bottom surface of said base.

13. A seating device for the therapeutic support of the bottom area of a human comprising a pair of separate generally longitudinally oriented panels, each having a generally planar upper surface for the respective supporting contact with the respective buttock and upper rear thigh portions of said human, a base in turn having an upper surface and means for connecting said panels to said base at a position wherein said panel upper surfaces are vertically spaced from said base upper surface, said panels further compositively defining a pair of inner edge walls disposed in laterally spaced opposition to each other so as to form a longitudinally directed central relief opening between said panels such that the centrally disposed genital areas of said human user do not contact said panels or said base upper surface when said device is used to support said human, said means for connecting said panels to said base comprising a pair of longitudinally oriented channel members having vertically opposed upper and lower walls and at least one connecting side wall, said panels being in turn respectively connected to said channel members and including a pair of piano type hinges longitudinally extending and respectively secured to both said channel and each of said panels.

14. A seating device for the therapeutic support of the bottom area of a human comprising a pair of separate generally longitudinally oriented panels, each having a generally planar upper surface for the respective supporting contact with the respective buttock and upper rear thigh portions of said human, a base in turn having an upper surface and means for connecting said panels to said base at a position wherein said panel upper surfaces are vertically spaced from said base upper surface, said panels further compositively defining a pair of inner edge walls disposed in laterally spaced opposition to each other so as to form a longitudinally directed central relief opening between said panels such that the centrally disposed genital areas of said human user do not contact said panels or said base upper surface when said device is used to support said human, said base being a peripheral frame having an open center area, said inner edge walls of said panels inwardly notched such that portions of said inner edge walls may downwardly move into said open center area beneath said base upper surface for greater tilt adjustment of said seating device.

* * * * *